US005078065A

United States Patent [19]

Tsunemi et al.

[11] Patent Number: 5,078,065

[45] Date of Patent: Jan. 7, 1992

[54] INCINERATING-FUSING SYSTEM FOR CITY REFUSE DISPOSAL

[75] Inventors: Takeshi Tsunemi; Takashi Fujii, both of Osaka, Japan

[73] Assignee: Osaka Gas Co., Ltd., Osaka, Japan

[21] Appl. No.: 668,628

[22] Filed: Mar. 13, 1991

[30] Foreign Application Priority Data

Mar. 15, 1990 [JP] Japan ..... 2-64591

[51] Int. Cl.[5] ..... F23G 5/00; F23G 5/12

[52] U.S. Cl. ..... 110/259; 110/165 R; 110/165 A; 110/171; 110/245

[58] Field of Search ..... 110/259, 165 R, 165 A, 110/171, 346, 245

[56] References Cited

U.S. PATENT DOCUMENTS

| | | | |
|---|---|---|---|
| 3,537,410 | 11/1970 | Zanft | 110/165 R |
| 4,201,141 | 5/1980 | Teodorescu et al. | 110/259 |
| 4,346,661 | 8/1982 | Nakamura | 110/259 |
| 4,977,837 | 12/1990 | Roos et al. | 110/165 A |

FOREIGN PATENT DOCUMENTS

| | | | |
|---|---|---|---|
| 1039687 | 9/1958 | Fed. Rep. of Germany | 110/165 A |
| 0154169 | 12/1979 | Japan | 110/259 |
| 0091129 | 5/1985 | Japan | 110/259 |

*Primary Examiner*—Edward G. Favors

*Attorney, Agent, or Firm*—Gifford, Groh, Sprinkle, Patmore and Anderson

[57] ABSTRACT

An incinerating-fusing system for city refuse is disclosed. The system includes an incinerating furnace for incinerating city refuse, a fusing furnace for fusing ash from the incinerating furnace at a high-temperature hearth formed of carbon type combustible material, a communicating passage directly communicating an ash chute of the incinerating furnace with the fusing furnace, the communicating passage acting for dropping ash from the incinerating furnace and also for upwardly exhausting exhaust gas from the fusing furnace. The system further includes a dust collector disposed in an exhaust gas passage extending from the incinerating furnace and a dust conveying passage extending from inside of a high-temperature hearth of the fusing furnace so as to introduce dust from the dust collector.

10 Claims, 4 Drawing Sheets

INCINERATING-FUSING SYSTEM FOR CITY REFUSE DISPOSAL

BACKGROUND OF THE INVENTION

1 FIELD OF THE INVENTION

The present invention relates to an incinerating-fusing system for city refuse disposal, and more particularly to a system of the above type used including an incinerating furnace for incinerating city refuse and a fusing furnace for fusing ash from the incinerating furnace at a high-temperature hearth formed of carbon type combustible material.

2 DESCRIPTION OF THE RELATED ART

According to a conventional system for incinerating city refuse, an incinerating furnace and a fusing furnace are separately provided. The system further includes a separator for separating such incombatible materials or objects as electric appliances and kitchen utensil from wet ash from an ash extruder attached to the incinerating furnace and a dryer for drying the wet ash from the separator. The dried ash from this drier is charged into the fusing furnace.

The fusing hearth is constructed as a vertical type hearth having a considerable height so as to after-burn unburned gas generated inside this fusing furnace.

Further, dust collected by a dust collector, especially EP (electrostatically precipitated) dust collected by an electrostatic precipitator disposed in an exhaust gas passage extending from the incinerating furnace is disposed through e.g. concrete caking treatment, separately from the ash.

As described above, the conventional system requires many components such as the large ash extruder, the separator, the drier and so on. Further, the fusing furnace tends to be physically large. As a result, the entire system is very costly in both installation and running-/maintenance costs. Moreover, the disposal of the dust such as the EP dust is very costly as well.

Taking the above-described state of the art into consideration, the primary object of the present invention is to provide a system of the above-described type with improvement. The improvement afforded by the invention achieves economy of the system size by eliminating the ash extruder, the separator and the drier and also economy of the system installation, running and maintenance costs. The improvement also enables an efficient and inexpensive integral disposal of generated dust together with ash.

SUMMARY OF THE INVENTION

For accomplishing the above-noted object, an incinerating-fusing system for city refuse disposal, according to the present invention, comprises: an incinerating furnace for incinerating city refuse; a fusing furnace for fusing ash from the incinerating furnace at a high-temperature hearth formed of carbon type combustible material; a communicating passage directly communicating an ash chute of the incinerating furnace with the fusing furnace, the communicating passage acting for dropping ash from the incinerating furnace and also for upwardly exhausting exhaust gas from the fusing furnace; a dust collector disposed in an exhaust gas passage extending from the incinerating furnace; and a dust conveying passage extending from inside of a high-temperature hearth of the fusing furnace so as to introduce dust from the dust collector.

Functions and effects of the above-described construction will be detailed next.

The ash from the ash chute of the incinerating furnace is directly fed to the fusing furnace through the communicating passage. With this, the system can eliminate the large ash extruder, the separator and the drier, whereby the system installation costs and running-maintenance costs can be significantly reduced.

Further, the exhaust gas from the fusing furnace is recycled to the incinerating furnace, such that the unburned gas generated in the fusing furnace can be after-burnt inside the incinerating furnace. Thus, the system can also eliminate the after-burning space provided in the inside of the fusing furnace of the convention. As a result, the fusing furnace can be formed very compact and economical in its installation.

Moreover, the single and simple communicating passage extended between the incinerating furnace and the fusing furnace acts both for feeding of the ash from the former to the latter and for recycling of the exhaust gas from the latter to the former. As a result, the invention's system can minimize the special devices for these operations.

According to one preferred embodiment of the invention, an electrostatic precipitator is used as the dust collector. With this, EP dust generated from the electrostatic precipitator is conveyed through the convery-ing passage into the high-temperature hearth of the fusing furnace for fusing disposal of the dust. As a result, the system can efficiently dispose the EP dust without scattering of the dust and also economically dispose the EP dust together with the ash.

Consequently, the invention has fully achieved the intended object of providing an incinerating-fusing system for city refusal with improvement which achieves economy of the system size by eliminating the ash extruder, the separator and the drier and also economy of the system installation, running and maintenance costs. The improvement also enables an efficient and inexpensive integral disposal of generated dust together with ash.

According to a further embodiment of the present invention, an incinerating-fusing system for city refuse disposal comprises: an incinerating furnace for incinerating city refuse; a fusing furnace for fusing ash from the incinerating furnace at a high-temperature hearth formed of carbon type combustible material; a closed type ash conveying passage air-tightly connecting between an ash collecting passage of the incinerating furnace and an ash charge opening of the fusing furnace; an exhaust gas passage connecting between a combustion chamber of the incinerating furnace and the fusing furnace; a dust collector disposed in an exhaust gas passage extending from the incinerating furnace; and a dust conveying passage extending from inside of a high-temperature hearth of the fusing furnace so as to introduce dust from the dust collector. The alternate construction also achieves the distinguished effects of the foregoing construction of the invention.

More particularly, the ash from the ash collecting passage extending from the incinerating passage is directly fed to the fusing furnace through the closed type ash conveying passage. As a result, the system can eliminate the ash extruder, the separator and the drier, whereby the entire system costs, i.e. installation, running-maintenance costs can be significantly reduced.

Further, since the exhaust gas from the fusing furnace is conveyed to the combustion chamber of the incinerating furnace, the system can also eliminate the after-burning space, such that the installation costs of the fusing furnace can be considerably reduced.

Moreover, since the feeding of ash to the fusing furnace and the gas exhaust from the fusing furnace are separately effected through the closed type ash conveying passage and the gas exhaust passage, the system can effectively prevent scattering of the ash into the incinerating furnace by the exhaust gas. As a result, the system can achieve higher ash fusing performance and can prevent trouble associated with scattering of the ash inside the incinerating furnace. Moreover, the closed type ash conveying passage can upwardly convey the ash without any disadvantageous effect on the incinerating and gas exhausting conditions inside the incinerating furnace. Accordingly, the fusing furnace can be installed at an optimum altitude where installation of the furnace is most economical.

Further and other objects, features and effects of the invention will become more apparent from the following more detailed description of the embodiments of the invention with reference to the accompanying drawings.

DESCRIPTION OF THE PREFERRED EMBODIMENTS

Preferred embodiments of an incinerating-fusing system for city refuse disposal will now be described in particular with reference to the accompanying drawings.

Figure 1:
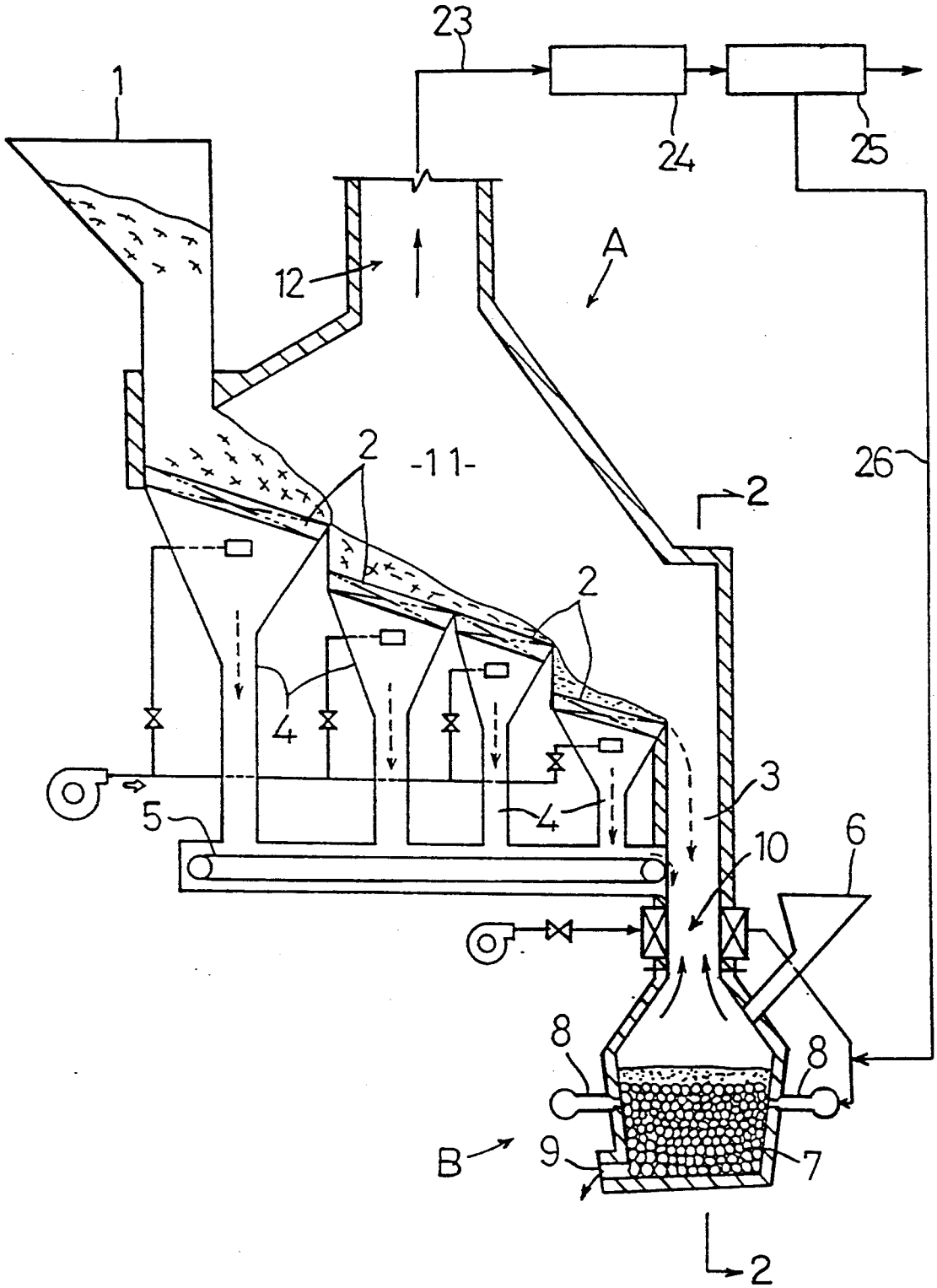
FIG. 1 is a conceptual view illustrating a system according to one preferred embodiment of the invention.
Figure 2:
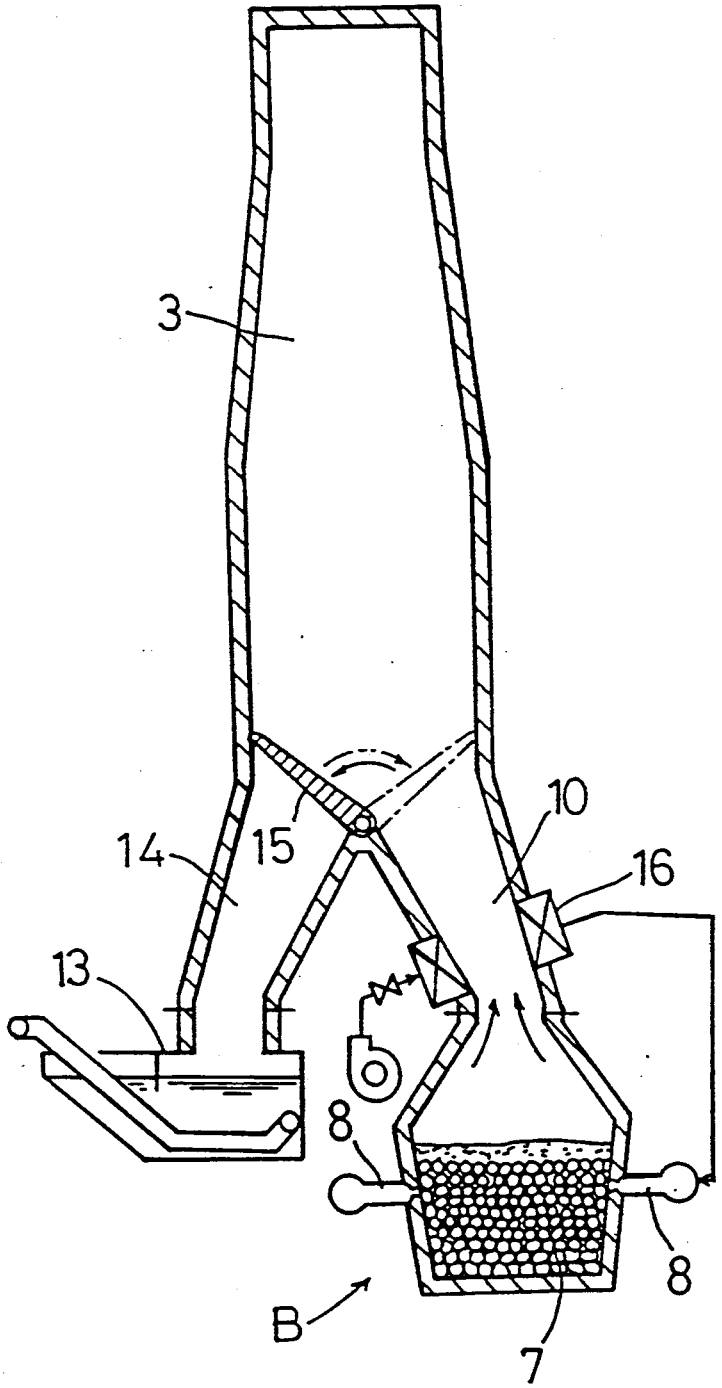
FIG. 2 is a perspective view along a line 2—2 of FIG. 1.

FIGS. 1 and 2 show a system according to one embodiment of the invention. With this system, as shown, city refuse charged through a hopper 1 is dropped onto a movable grate 2 and conveyed thereon towards an ash chute 3. That is, the refuse on the movable grate is incinerated with air fed from a combustion air feed dust 4 acting also as an ash collecting chute and the incineration ash is conveyed on a dry type conveyor 5 to the ash chute 3. These components together construct a skirt type incinerating furnace A.

On the other hand, a high-temperature hearth 7 is formed of carbon type combustible material such as cokes from the hopper 6. In a fusing furnace B using this high-temperature hearth 7, the high-temperature hearth 7 is burnt with combustion air from a tuyere 8, such that the ash on the hearth 7 is fused and the fusion sludge is collected through a flow-down passage 9.

To the ash chute 3 of the incinerating furnace A, the fusing furnace B is directly connected through a communicating passage 10 acting both for feeding of the ash from the former to the latter and for recycling of the exhaust gas from the latter to the former. That is, the ash generated through the incineration is fed directly to the fusing furnace B and also the exhaust gas from the fusing furnace B is recycled to a combustion chamber 11 of the incinerating furnace A for after-burning treatment and the resultant gas is sent to a gas flue 12 of the incinerating furnace A.

Further, as shown in FIG. 2, the communicating passage 10 is connected through a further ash chute 14 with an ash collecting water sealing tank 13 for collecting the ash after wetting the ash in water. Also, a switching damper 15 is provided for selectably feeding the ash to the fusing furnace B or to the water sealing tank 13. In operation, when the fusing furnace B is at halt, the ash is sent to the water sealing tank 13 and the incinerating furnace A is operated.

A preheater 16 is attached to the plate-like member forming the communicating passage 10 and this preheater 16 is connected with the tuyere 8 of the fusing furnace B. Accordingly, the combustion air fed to the fusing furnace B is pre-heated by the exhaust gas from the fusing furnace B; whereas, the exhaust gas is cooled and then conveyed to the incinerating furnace A.

In an exhaust gas passage 23 extending from the incinerating furnace A, there are provided an exhaust heat boiler 24 and an electrostatic precipitator 25. Further, a dust conveying passage 26 is provided for conveying electrostatically precipitated dust from the precipitator 25 together with the pre-heating combustion air to the tuyere 8 into the high-temperature hearth 7. Accordingly, the EP dust is disposed together with the ash. Also, the construction can prevent recycling of the dust into the furnace A by scattering of the dust. In the above-described system construction, the following modifications (a) through (d) are conceivable.

(a) The system can eliminate the ash collecting water sealing tank 13 or can use other ash disposal component such as an auxiliary high-temperature hearth type fusing furnace, in place of the tank 13.

(b) Instead of the switching dumper 15, other channel switching means of various types can be employed depending on the convenience.

(c) The attaching position of the preheater 16 can be changed. Or, this preheater 16 can be eliminated at all.

(d) The hopper 6 for charging the carbon type combustible material can be alternately connected with the ash chute 3 or with the ash conveying conveyor 5.

Figure 3:
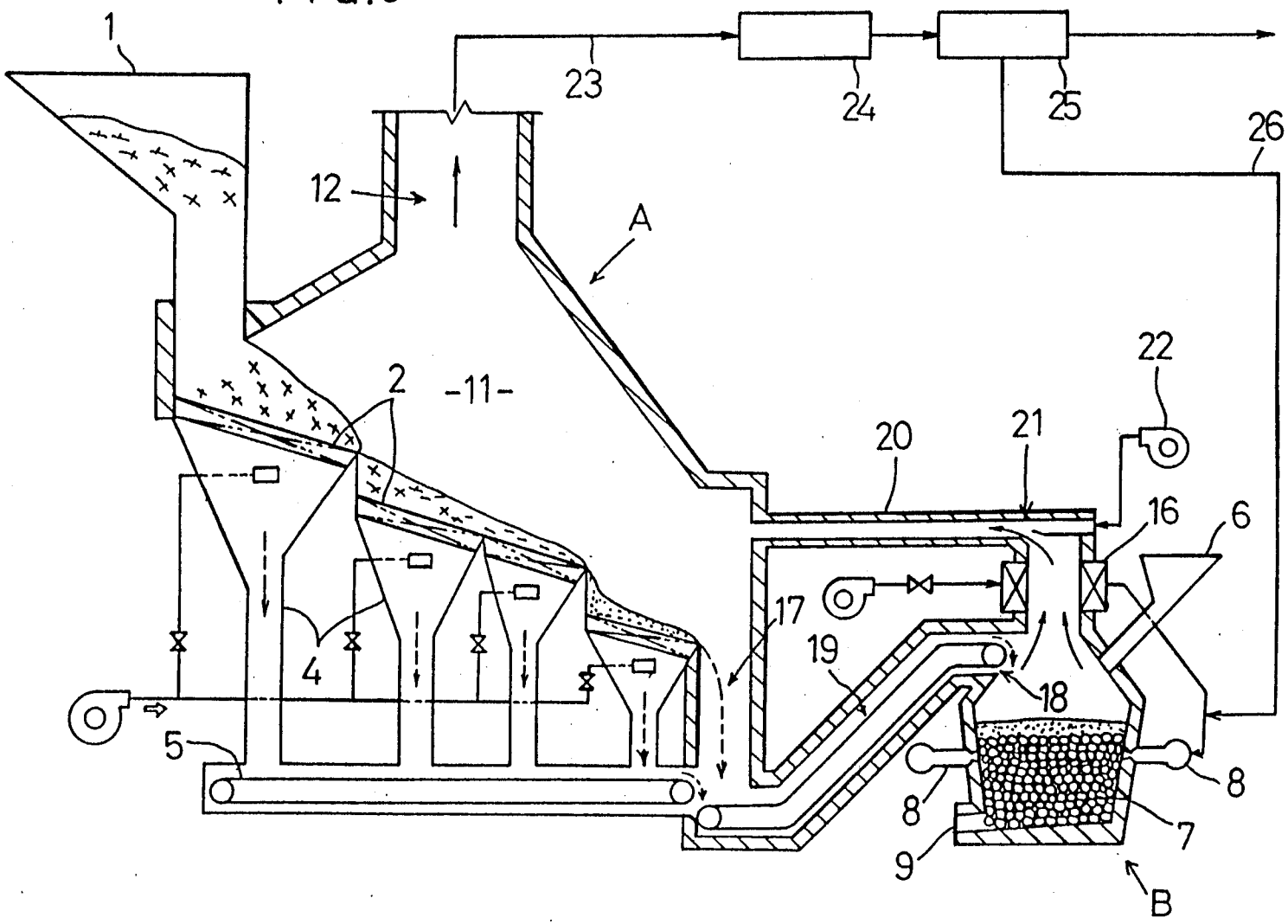
FIG. 3 is a conceptual view illustrating a system according to a further embodiment of the invention.

Another embodiment of the present invention will be described next with reference to FIG. 3.

In the following description of this embodiment, the same components as those in the foregoing embodiments are denoted with the same reference marks in the drawing and will not be particularly described.

An ash charge opening 18 of the fusing furnace b is connected to an ash collecting passage 17 of the incinerating furnace A through an ash conveying passage 19 having a high-temperature resistant conveyor capable of lift-conveying function, so that the fusing furnance B is installed at an altitude where the installation cost of the furnace is minimum. In this embodiment, the ash conveying passage 19 is constructed as a closed type air-tightly surrounded by partition walls, thus effectively preventing trouble due to intake of air through the ash charge opening 18 into the fusing furnance B.

Further, an exhaust gas passage 20 of the fusing furnace B is connected with the combustion chamber 11 of the incinerating furnace A; and an ejector 21 is disposed in the exhaust gas passage 20. Moreover, to the ejector 21, there is connected a blower 22 for feeding after-burning combustion air into the combustion chamber 11 of the incinerating furnace A, such that the exhaust gas taken from the fusing furnance B through the air current from the blower 22 is forcibly fed to the combustion chamber 11 while the exhaust gas is first cooled and then sent to the incinerating furnance A.

In this embodiment too, the following modifications (a) through (b) are conceivable.

(a) Any other forcible air exhaust means can be employed in placed of the ejector 21.

(b) The specific construction of the closed type ash conveying passage 19 can be conveniently modified. Also, its conveying direction is not limited to that disclosed in the above embodiment.

The specific constructions of the incinerating furnace A and the high-temperature hearth type fusing furnace B can be modified in terms of their disposing capacities, constructions and so on.

Figure 4:
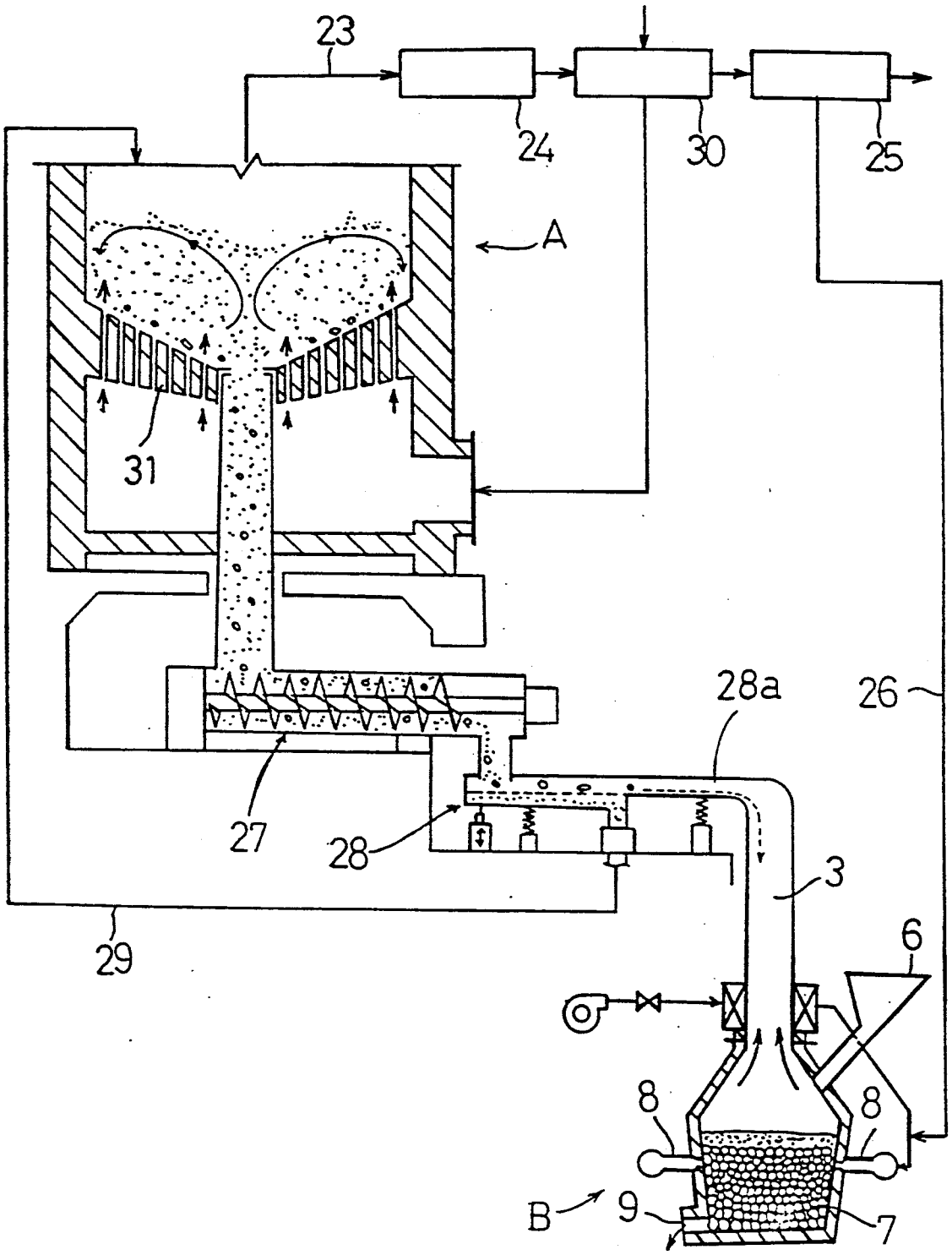
FIG. 4 is a conceptual view illustrating a system according to a still further embodiment of the invention.

For instance, the incinerating furnace A can be of a fluid bed type illustrated in FIG. 4. Incidentally, in this FIG. 4, a reference numeral 27 denotes a screw type extruder for extruding fluid sand and ash by predetermined amounts. A reference numeral 28 denotes a vibrating filter type separator for separating-collecting the fluid sand from the ash and then returning the sand to the inside of the incinerating furnance A through a recycling passage 29. A reference mark 28*a* denotes an ash exhaust opening for the separator 28. A reference numeral 30 denotes an heat exchanger for preheating the combustion air to be fed to the incinerating furnance A. A reference numeral 31 denotes a fluid bed.

The specific connecting construction between the dust conveying passage 26 and the fusing furnace B can be conveniently modified. For instance, it is conceivable to connect the dust conveying passage 26 directly with the fusing furnace B, so that the EP dust may be taken into the high-temperature hearth 7 by means of the air-nozzle effect.

Further, the dust collector can be of any other type than the disclosed electrostatic precipitator. For instances, the dust collector can be of cyclone, venturi scrubber, inertial dust collector type and so on.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An incinerating-fusing system for city refuse disposal, the system comprising:

an incinerating furnace for incinerating city refuse;

a fusing furnace for fusing ash from the incinerating furnace at a high-temperature hearth formed of carbon type combustible material;

a communicating passage directly communicating an ash chute of said incinerating furnace with said fusing furnace, said communicating passage acting for dropping ash from said incinerating furnace and also for upwardly exhausting exhaust gas from said fusing furnace;

a dust collector disposed in an exhaust gas passage extending from said incinerating furnace; and a dust conveying passage extending from inside of said high-temperature hearth of said fusing furnace so as to introduce dust from said dust collector.

2. A system as defined in claim 1, wherein said dust collector is an electrostatic precipitator and said dust is electrostatically precipitated dust.

3. A system as defined in claim 2, wherein said ash chute is capable of selectably feeding ash to said communicating passage or to an ash collecting water sealing tank by means of a dumper.

4. A system as defined in claim 3, wherein said communicating passage includes a preheater to which a tuyere of said fusing furnance is connected, so that the combustion air to be fed to said fusing furnance is preheated by the exhaust gas from said fusing furnace.

5. An incinerating-fusing system for city refuse disposal, the system comprising:

an incinerating furnace for incinerating city refuse;

a fusing furnace for fusing ash from the incinerating furnace at a high-temperature hearth formed of carbon type combustible material;

a closed type ash conveying passage air-tightly connecting between an ash collecting passage of said incinerating furnace and an ash charge opening of said fusing furance;

an exhaust gas passage connecting between a combustion chamber of said incinerating furnace and said fusing furnance;

a dust collector disposed in an exhaust gas passage extending from said incinerating furnace; and a dust conveying passage extending from inside of said high-temperature hearth of said fusing furnace so as to introduce dust from said dust collector.

6. A system as defined in claim 5, wherein said dust collector is an electrostatic precipitator and said dust is electrostatically precipitated dust.

7. A system as defined in claim 6, wherein said closed type ash conveying passage has a high-temperature resistant conveyor capable of lift-conveying function.

8. An incinerating-fusing system for city refuse disposal, the system comprising:

an incinerating furnace for incinerating city refuse;

a fusing furnace for fusing ash from the incinerating furnace at a high-temperature hearth formed of carbon type combustible material;

said incinerating furnace including a fluid bed, an extruder for extruding fluid sand and ash from said fluid bed and a separator for separating said fluid sand from said ash and returning the fluid sand into said incinerating furnance through a recycling passage;

an ash chute directly communicating an ash exhaust opening of said separator and said fusing furnance, said chute acting for dropping ash from said incinerating furnace and also for upwardly exhausting exhaust gas from said fusing furnace;

a dust collector disposed in an exhaust gas passage extending from said incinerating furnace; and a dust conveying passage extending from inside of said high-temperature hearth of said fusing furnace so as to introduce dust from said dust collector.

9. A system as defined in claim 8, wherein said dust collector is an electrostatic precipitator and said dust is electrostatically precipitated dust.

10. A system as defined in claim 9, wherein said extruder is a screw type extruder for extruding the fluid sand and the ash by predetermined amounts and said separator is a vibration filter type separator.

* * * * *